US008387698B1

(12) United States Patent
Foley et al.

(10) Patent No.: US 8,387,698 B1
(45) **Date of Patent: *Mar. 5, 2013**

(54) GAS RECOVERY COMPONENT HEATING SYSTEM

(75) Inventors: Patricia J. Foley, Mexia, TX (US); Stuart D. LeNoir, Groesbeck, TX (US); James M. Robison, Groesbeck, TX (US); Jerry A. Staggs, Mexia, TX (US)

(73) Assignee: Accurate Pumping & Contracting, Inc., MMSOB Division, Mexia, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/464,825

(22) Filed: May 4, 2012

Related U.S. Application Data

(63) Continuation of application No. 12/535,388, filed on Aug. 4, 2009, now Pat. No. 8,176,983.

(51) Int. Cl.
*E21B 36/00* (2006.01)

(52) U.S. Cl. ..... 166/302; 166/57; 166/901; 137/375

(58) Field of Classification Search ..... 166/901, 166/302, 57–62; 137/375
See application file for complete search history.

(56) References Cited

U.S. PATENT DOCUMENTS

| | | | | |
|---|---|---|---|---|
| 2,932,352 | A | 4/1960 | Stegemeier | |
| 8,176,983 | B1 * | 5/2012 | Foley et al. | 166/302 |
| 2006/0201668 | A1 | 9/2006 | Benoit et al. | |
| 2007/0080184 | A1 | 4/2007 | Cowen et al. | |
| 2007/0289636 | A1 | 12/2007 | Chitwood et al. | |

* cited by examiner

*Primary Examiner* — Kenneth L Thompson
*Assistant Examiner* — Yong-Suk (Philip) Ro
(74) *Attorney, Agent, or Firm* — Fulbright & Jaworski L.L.P.

(57) ABSTRACT

A gas recovery component heating apparatus and method of use. The apparatus includes an insulating shell and at least one heating element positioned along the interior of the insulating shell. The apparatus further includes one or more apertures configured to allow a portion of the gas recovery component to pass through the aperture when the apparatus is secured about the gas recovery component. The apparatus also includes a mechanism for securing the apparatus about the gas recovery component.

31 Claims, 3 Drawing Sheets

GAS RECOVERY COMPONENT HEATING SYSTEM

CROSS-REFERENCE TO RELATED APPLICATIONS

This application is a continuation of U.S. application Ser. No. 12/535,388 filed Aug. 4, 2009 and entitled "GAS RECOVERY HEATING SYSTEM," the disclosure of which is incorporated herein by reference.

TECHNICAL FIELD

The present invention generally relates to gas recovery operations. In particular, the present invention relates to efficiently heating gas recovery components in gas recovery operations.

BACKGROUND OF THE INVENTION

A fracturing stack, often simply referred to as a "frac stack," is a device used at the well head to transfer pressurized fluid downhole. The pressurized fluid fractures the subterranean strata, thereby releasing gas trapped in that strata and facilitating the recovery of otherwise unreachable gas. Oftentimes, after a frac stack has been used, it is left at the wellhead until permanent recovery equipment can be set up to replace the frac stack, at which point the well becomes "live." During the course of normal recovery operations, a frac stack may remain at the wellhead for a period of several days or even several months before the permanent recovery equipment is put into place.

After the well is fractured and before the well becomes live, the frac stack is used to seal the well at the wellhead through a series of valves. As the various valves are closed, a mixture of gas and water remains trapped there between.

Notably, when gas is trapped within the frac stack or frac tree, it is under tremendous pressure. Often times, for example, the gas may be compressed from a 3 inch pipeline to a ¾ inch pipeline. Under these conditions, the gas can freeze at temperatures as high as 52 degrees Fahrenheit. If gas trapped within the frac stack becomes frozen, the results can be devastating for a well operator. Consider the case where a well operator initiates permanent production of a well, i.e., makes a well live. In that case, the well operator must dedicate a team of individuals and thousands of dollars worth of equipment to that well. If the gas is frozen, the valves of the frac stack cannot open, gas cannot freely flow and, thus, the well cannot produce. At that point, between manpower, equipment, and the lost production of gas, the operator is losing tens of thousands of dollars per hour. Put simply, such a result cannot be tolerated.

Currently, well operators maintain frac stacks above a freezing point using rudimentary means. Commonly, a well operator will place flood lights or a portable heater around the frac stack and cover the set up with a tarp. The flood lights or portable heater must be powered by a portable generator. Such a scheme is undesirable because it requires the transport of several materials to remote job sites, the use of gas or diesel, and regular maintenance by individuals. Accordingly, this process is relatively expensive in terms of materials and manpower requirements.

BRIEF SUMMARY OF THE INVENTION

According to a first aspect of the invention, a gas recovery component heating apparatus includes an insulating shell and at least one heating element positioned along the interior of the insulating shell. The apparatus further includes one or more apertures configured to allow a portion of the gas recovery component to pass through the aperture when the apparatus is secured about the gas recovery component. The apparatus also includes a mechanism for securing the apparatus about the gas recovery component.

According to another aspect of the present invention, a method for heating a gas recovery component includes securing a heating apparatus about the gas recovery component, where the heating apparatus comprises an insulating shell, at least one heating element, and at least one aperture configured for allowing a portion of the component to pass therethrough. The method also includes powering the heating element and heating the gas recovery component in response to powering.

According to yet another aspect of the present invention, a method for regulating the temperature of a gas recovery component includes taking a temperature measurement at the gas recovery component. The method further includes transmitting the measured temperature to a remote location and then receiving a temperature adjustment command in response to transmitting. Finally, the method includes adjusting the temperature of the gas recovery component in response to receiving the temperature change command where the temperature is adjusted, at least in part, by varying the current through a heating element where the heating element is positioned along the interior of a first insulating shell.

According to yet another aspect of the present invention, an apparatus for regulating the temperature of a gas recovery component includes a temperature sensor for sensing the temperature at the well head. The apparatus also includes a transmitter for transmitting the measured temperature to a remote location and a receiver for receiving a temperature adjustment command in response to the transmitting. The apparatus further includes a circuit controller for adjusting the temperature of the gas recovery component in response to receiving the command; where the temperature is adjusted, at least in part, by varying the current through a heating element, where the heating element is positioned along the interior of a first insulating shell.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
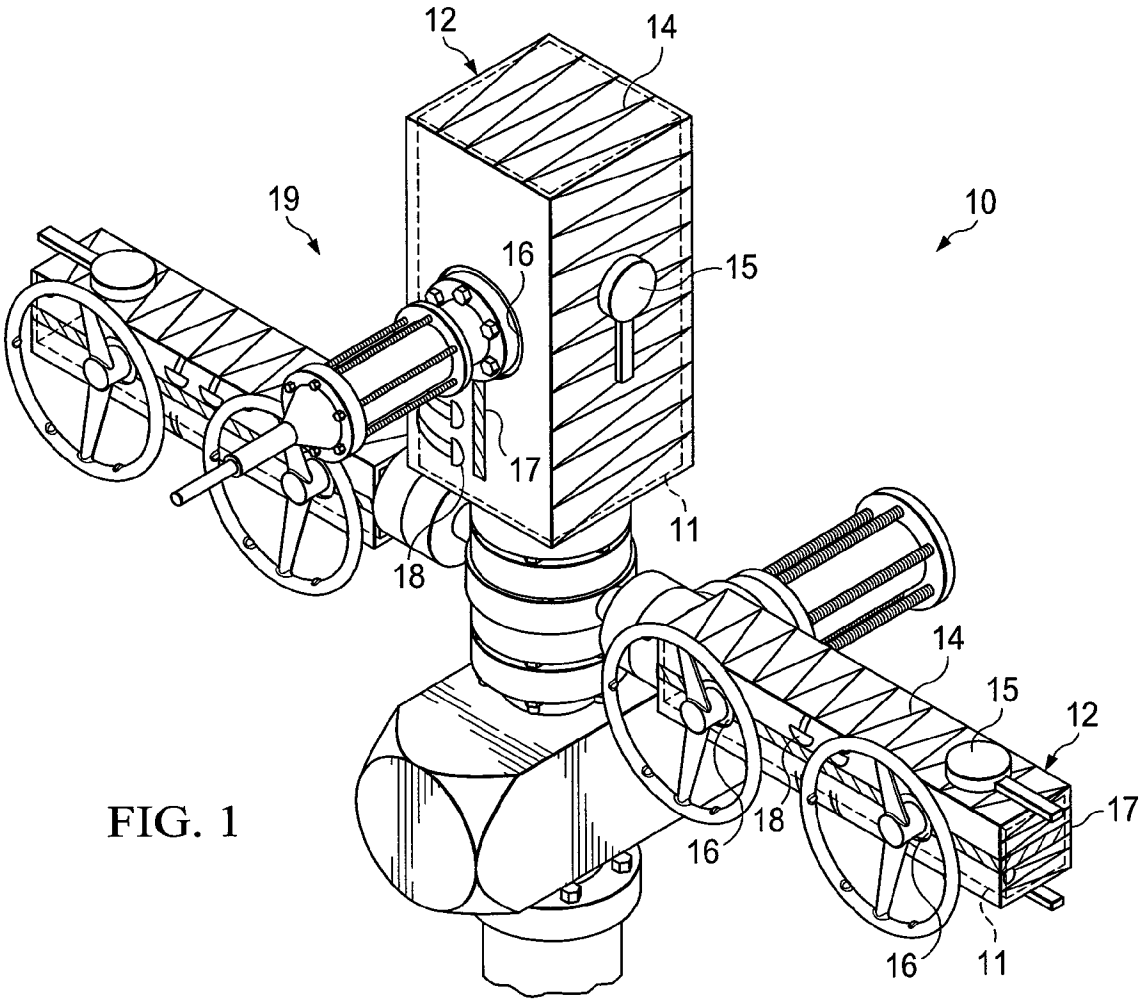
FIG. 1 is a depiction of an embodiment an apparatus according to an aspect of the present invention secured about a recovery component.

A preferred embodiment of a well head heating apparatus 10 according to the present invention is depicted at FIG. 1. Apparatus 10 can be utilized to maintain the temperature of gas recovery components, e.g., a frac stack above a freezing point. In doing so, apparatus 10 provides distinct advantages over known methods of heating gas recovery components. By way of example, once apparatus 10 is installed about a well-head component, it operates to insulate or maintain the temperature of that component in a maintenance free manner. Also, in contrast with currently employed procedures, certain embodiments of apparatus 10 operate without the use of gas or diesel, and therefore, are environmentally friendly. Moreover, apparatus 10 has a relatively low operating cost, as it can be configured to operate using a 120V or 240V power supply. As a result, apparatus 10 can be serviced by a temporary power pole or similar power source.

The following description of the present invention is at times in terms of utilization with a well head recovery device, such as frac stack. However, it should be appreciated that the present invention is equally useful when utilized with other gas recovery components, specifically, at any point in the gas production process where gas undergoes a pressure increase or otherwise subject to temperature decrease. As known, at such points the freezing point of the pressurized gas increases. It is at these points (or in such components), e.g., that the present invention is particularly useful. Therefore, the present invention can be utilized with gas recovery components throughout the production process and is not limited to use at the well head.

As will be discussed in greater detail, apparatus 10 can be modified to insulate gas recovery components, including gas recovery components, of different configurations. For instance, gas recovery components such as frac stacks are often categorized according to different attributes including, e.g., valve size. For instance, a frac stack may be one of a 5K-type, 10K-type, or 15-K type depending on valve size. As such, apparatus 10 can be configured to be installed at, e.g., a 5K-type frac stack, 10K-type frac stack, or 15K-type frac stack, whereby apertures within apparatus 10 are sized and spaced from one another to align with valves of different types, depending upon the specific application.

As shown, apparatus 10 comprises an outer shell 11, which substantially surrounds other components. Outer shell 11 is preferably comprised of an insulating, durable material that is sufficient to resist wear and tear; UV radiation, moisture, and other environmental variables. According to one embodiment, outer shell 11 is comprised of insulating material manufactured by MIT Industrial of Houston, Tex. In any event, the particular type of material used for outer shell 11 is not germane to the present invention. As will be apparent to those skilled in the art, different materials may be readily used in accordance with the present invention.

Inner shell 12 is adjacently aligned with outer shell 11. Similar to outer shell 11, inner shell 12 is also desirably resistant to environmental conditions such as UV radiation, moisture, and the like. According to one embodiment, inner shell 12 is comprised of insulating material manufactured by MIT Industrial of Houston, Tex. In any event, the particular type of material used for outer shell 11 is not germane to the present invention. As will be apparent to those skilled in the art, different materials may be readily used in accordance with the present invention.

Outer shell 11 and inner shell 12 can be secured to one another by a series of fastener combinations. That is, a fastener combination may comprise a washer on each end of the fastener combination, each washer biasing shell 11 and shell 12 towards the other. Other useful embodiments are envisioned whereby outer shell 11 and inner shell 12 are held in alignment a variety of means. For example, outer shell 11 and inner shell 12 can be reversibly mated to one another using a Velcro-type mechanism and the like.

It should be appreciated that, according to a preferred embodiment, outer shell 11 and inner shell 12 are sufficiently flexible to bend around the contours of frac stack 19 and conform thereto. If outer shell 11 and inner shell 12 are sufficiently flexible, a user can manipulate the same when installing apparatus 10 about frac stack 19. If sufficiently flexible, apparatus 10 can wrap around frac stack 19, be secured thereto, and later be removed therefrom in reverse fashion.

Heating element 14 is positioned between inner shell 12 and outer shell 11. According to a preferred embodiment, heating element 14 comprises a conductor, such as a conducting wire, that increases in temperature as current is passed therethrough. The temperature increase of heating element 14 is directly proportional to the amount of current passed through heating element 14. Ideally, an operator is able to control the amount of current passing through, and likewise the increase in temperature of, heating element 14 using a circuit controller, as known in the art. This feature conserves energy where only moderate heating of heating element 14 is required to keep gas within frac stack 19 above its freezing point.

Referring to the embodiment depicted at FIG. 1, heating element 14 comprises a conducting wire sandwiched between inner shell 12 and outer shell 11, where heating element 14 extends there between in a grid-like fashion. That is, heating element 14 extends vertically and horizontally to form a grid along the roughly planar surfaces of inner shell 12 and outer shell 11. In other embodiments, heating element 14 may simply extend back and forth along the surfaces of inner shell 12 and outer shell 11 in zigzag fashion. In some embodiments, the contours of heating element 14 may be defined by wrapping element 14 around a fastening combination (discussed above), or heating element 14 can be held in place by other means, such as wire straps, separate fasteners, and the like.

In any event, a preferred feature associated with heating element 14 is that it can be configured to provide even heating of apparatus 10. That is, element 14 is preferably spaced about the surfaces of inner shell 12 and outer shell 11, so that heat can be dissipated by those components evenly throughout apparatus 10. This ensures even heating of apparatus 10, and avoids undesirable hot spots or cold spots. According to one embodiment, heating element 14 is known as "Heat Trace" as manufactured by Chloromax of Columbus, Ohio. In any event, the particular type of material used for heating element 14 is not germane to the present invention. As will be apparent to those skilled in the art, different materials may be readily used in accordance with the present invention.

Heating element 14 is coupled to an external power source at junction box 15. As depicted at FIG. 1, junction box 15 is positioned on the surface of outer shell 11, so that an operator can easily connect or disconnect apparatus 10 from the external power source. As mentioned above, heating element 14 may be powered by a 120 V or 240 V power source. As such, the external power source could be a portable generator or the like. However, heating element 14 is preferably eclectically coupled with, and powered by, a temporary power pole or similar mechanism. This arrangement is preferred because it is relatively maintenance free, environmentally friendly, inexpensive, and easy to install and remove.

It should be appreciated that, in order to be compliant with applicable rules and regulations, the electrical components of apparatus 10 must be rated as American Petroleum Institution (API) Class I, Division I (i.e., where vapors are present in the surrounding air) or Class I, Division II (where vapors are confined), depending upon the particular application. As such, components of apparatus 10 are built to specification so that they are explosion proof under Class I Division I or Class I Division II conditions, depending on the specific application for which apparatus 10 will be utilized. As such, heating element 14 and junction box 15 qualify as "explosion proof" and "fire proof." This is set forth in the National Electric Code (NEC) Handbook, the entirety of which is incorporated herein by reference. Accordingly, heating element 14 and junction box 15 must be made of particular materials to meet these requirements. As such, in a preferred embodiment, junction box may be one made by Crouse-Hinds, a Copper Industries, Inc. business or Appleton Electric of the EGS Electrical Group, a division of Emerson Industrial Automation.

Referring again to FIG. 1, apparatus 10 is further characterized by one or more apertures 16. The specific arrangement of apertures 16 depends to some extent on the type and size of the gas recovery component on which apparatus 10 is to be installed. By way of example, where apparatus 10 is to be installed on the main trunk of a 10 k-type frac tree, apparatus 10 will have a plurality of apertures 16 spaced accordingly, so that each aperture allows a valve handle to pass through while providing sufficient insulation about that handle. The objective of specifically configuring apparatus 10 according to a particular type of well head is to provide an operator easy access to each valve handle while still providing insulating properties within the vicinity of each valve handle. Accordingly, the size, spacing, and number of apertures 16 within apparatus 10 will generally dependent upon the type of gas recovery component (e.g., a 10K vs. 15K) on which apparatus 10 is being installed.

To that end, apparatus 10 also has one or more seams 17 extending from aperture 16 along the surfaces of inner shell 12 and outer shell 11. As mentioned above, the material comprising inner shell 12 and outer shell 11 should provide some flexibility so that an operator can manipulate apparatus 10 when fitting the same on a gas recovery component. As such, apparatus 10 is able to bend somewhat so that, about seam 17, apparatus 10 deforms from its original shape, e.g., becoming wider to accept the circumference of gas recovery component. As such, seam 17 may be widened to allow apparatus 10 to fit around the circumference of a gas recovery component.

As depicted in FIG. 1, apparatus 10 may be secured about a gas recovery component using one or belt and buckle combinations 18. As seen, belt and buckle combination extends across seam 17 and may be used to cinch apparatus 10 about the gas recovery component. Also, other useful embodiments are envisioned where apparatus 10 is secured using other mechanisms, such as a Velcro-type combination along seam 17.

Figure 2:
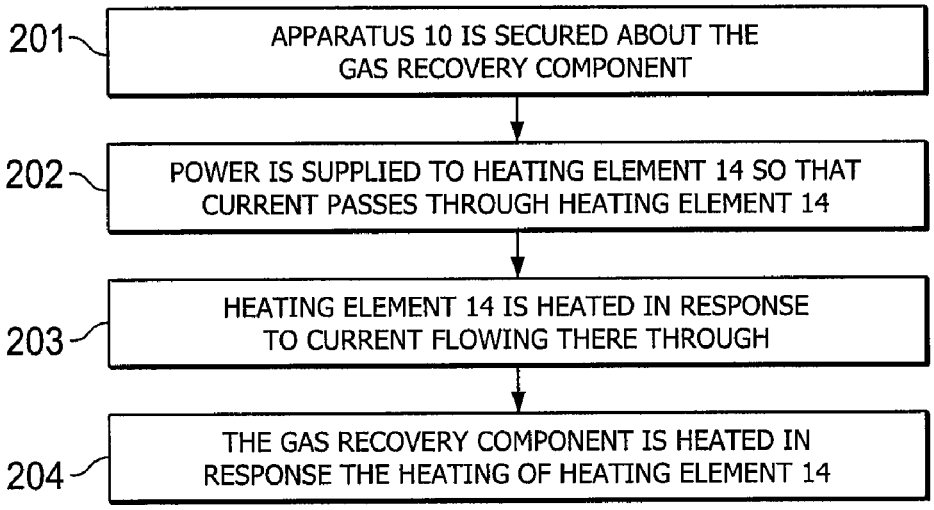
FIG. 2 represents a process according to another aspect of the present invention.

FIG. 2 represents a flow chart of a process according to an aspect of the present invention. According to FIG. 2, a process for heating a gas recovery component, e.g., a frac stack, is depicted. At step 201, apparatus 10 is secured about the gas recovery component. At step 202, power is supplied to heating element 14 so that current passes through heating element 14. At step 203, heating element 14 is heated in response to current flowing therethrough. At step 204, the gas recovery component is heated in response to the heating of heating element 14.

Figure 3:
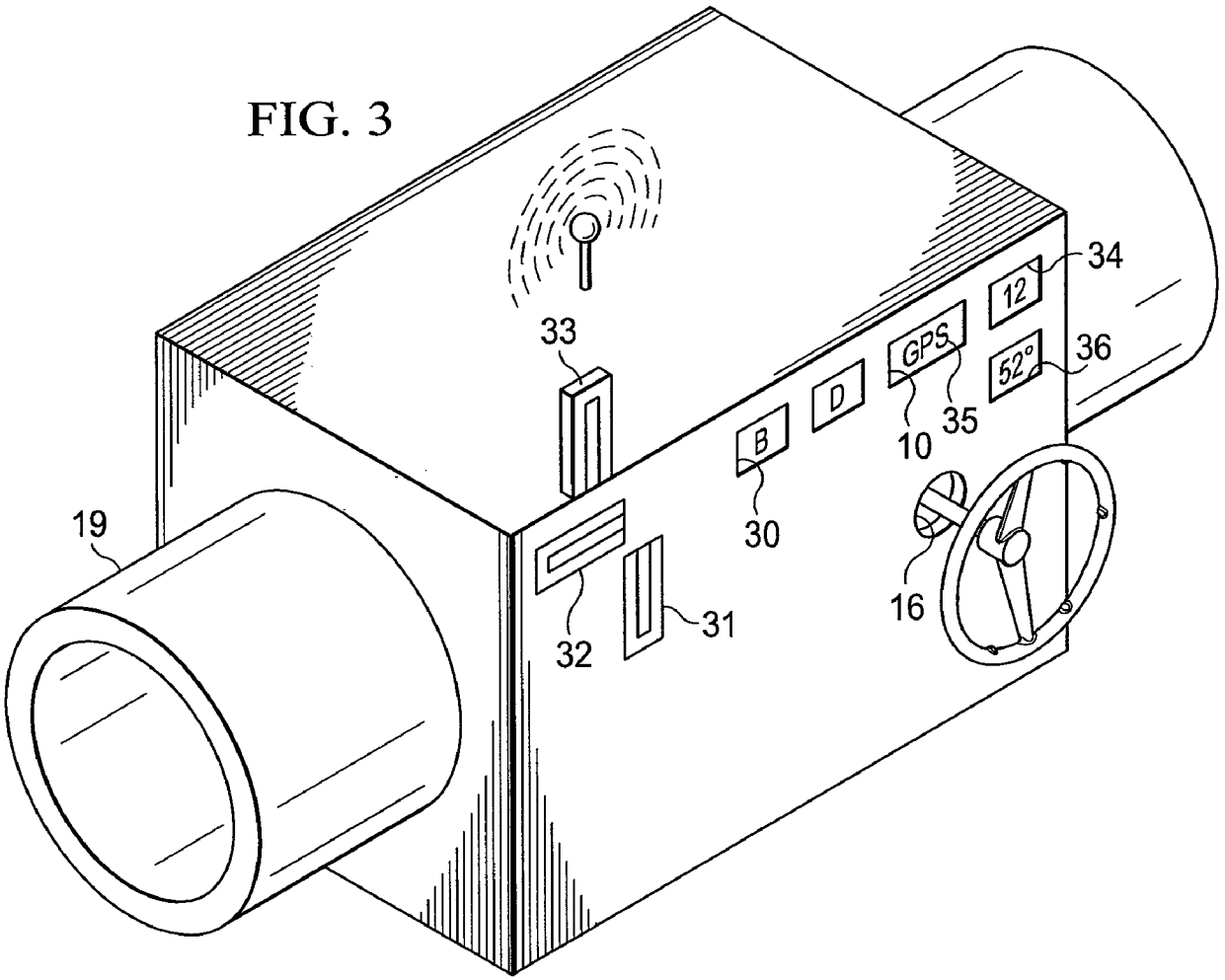
FIG. 3 is a depiction of an embodiment an apparatus according to another aspect of the present invention.

According to another aspect of the present invention, apparatus 10 may be configured for wireless communication. As depicted at FIG. 3, apparatus 10 is installed about a gas recovery component, e.g., frac stack 19. However, as further shown, apparatus 10 further comprises wireless subsystem 30. According to a preferred embodiment, wireless subsystem 30 comprises hardware, software, and/or firmware necessary to take local measurements at the well head and communicate with a remote station. For instance, subsystem 30 may comprise one or more temperature sensors, shown as sensor 31, sensor 32, and sensor 33, for measuring temperatures within the interior of frac stack 19, apparatus 10, and exterior temperature, respectively. Subsystem 30 may transmit these measurements to a remote station. Once these measurements are received, an operator or an automated system at the remote station may respond by transmitting an "increase temperature" command or "decrease temperature command" to subsystem 30. Accordingly, subsystem 30 is ideally in communication with heating element 14 and further comprises circuitry for adjusting the current through heating element 14. Subsystem 30 may communicate with heating element 14 using a control bus or the like that, e.g., may extend from subsystem 30 to a temperature control circuit at junction box 15. In this way, the temperature of apparatus 10 and frac stack 19 can be adjusted in real time. This, of course, is highly advantageous in that power may be conserved when moderate or no heating is required and additional power may be utilized in order to avoid a hard freeze.

Subsystem 30 may further comprise additional features, such as GPS circuitry 35 so that its location can be transmitted to a remote location, thereby helping a remote operator identify which apparatus of a plurality of same is being communicated with. Further, subsystem 30 may transmit an "error message" or "offline message" to the remote location in the event of sensor failure and the like.

Subsystem 30 is ideally powered by a low voltage power supply, e.g., a 12V or 24V power supply 34. As such, subsystem 30 may comprise a stand alone power supply, such as a battery, or may be powered using a transformer and control wire combination branched from junction box 15.

As further depicted at FIG. 3, subsystem 30 provides GUI 36, which displays temperature readings from each of sensors 31, 32, and 33, manual temperature controls, and the like. As such, an operator can make temperature adjustments through GUI 36.

In view of the above, subsystem 30 comprises necessary components for taking localized measurements, converting analog signals to digital signals (where necessary), and modulating and multiplexing those signals for transmission to the remote station. Subsystem 30 further comprises components necessary for demodulating and demultiplexing received signals from a remote location and necessary software and/or firmware instructions for executing commands received therefrom.

Figure 4:
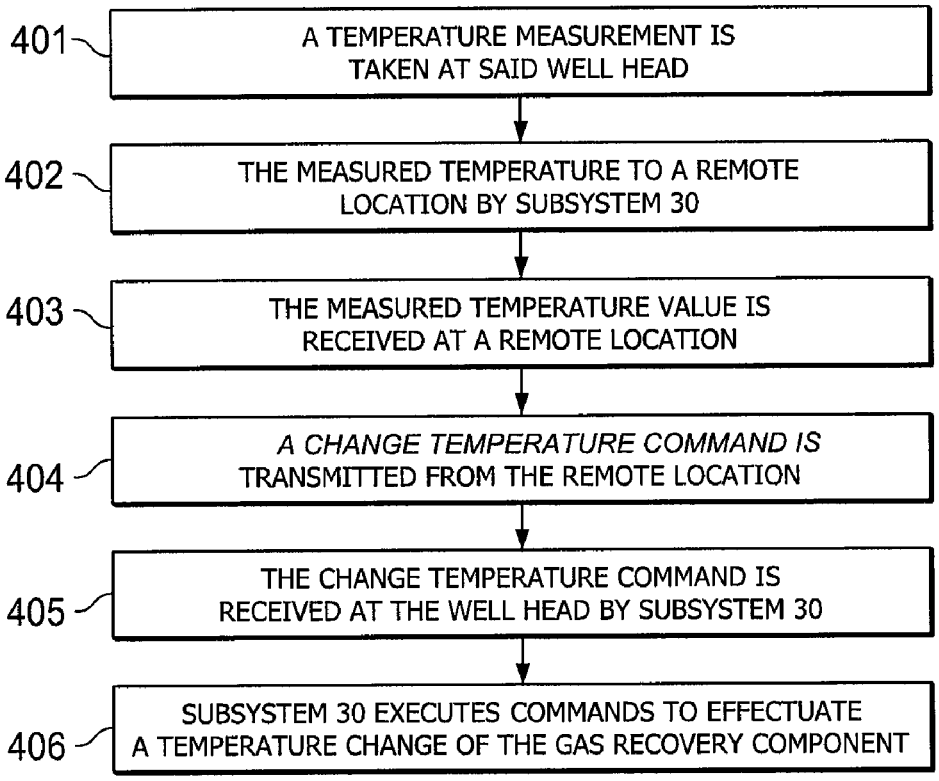
FIG. 4 represents a process according to another aspect of the present invention.

FIG. 4 represents a flow chart of a process according to an aspect of the present invention. According to FIG. 4, a process for regulating the temperature of a gas recovery component, e.g., a frac stack, is depicted. At step 401, a temperature measurement is taken at said well head. As discussed above, this measurement may be taken by one or more of sensors 31, 32, and 33. At step 402, the measured temperature is sent to a remote location by subsystem 30. At step 403, the measured temperature value is received at a remote location. A user or an automated system may compare the measured well head temperature to, for example, a desired well head temperature. At step 404, a change temperature command is transmitted from the remote location. At step 405, the change temperature command is received at the well head by subsystem 30. At step 406, subsystem 30 executes commands to effectuate a temperature change of the gas recovery component. As discussed above, this can be performed by, for example, sending a control signal to a circuit controller in communication with heating element 14.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A wellhead gas recovery component heating apparatus, said apparatus comprising:

first and second insulating shells;

at least one heating element, said heating element positioned between said first insulating shell and second insulating shell;

at least one aperture, said aperture configured to allow a portion of said wellhead gas recovery component to pass through said aperture when said apparatus is secured about said wellhead gas recovery component; and a mechanism for securing said apparatus about said wellhead gas recovery component.

2. The apparatus of claim 1 wherein said gas recovery component is a frac stack.

3. The apparatus of claim 1 wherein said apparatus is configured to be secured upon a 5K-type frac stack.

4. The apparatus of claim 1 wherein said apparatus is configured to be secured upon a 10K-type frac stack.

5. The apparatus of claim 1 wherein said apparatus is configured to be secured upon a 15K-type frac stack.

6. The apparatus of claim 1 further comprising:

a second insulating shell placed along the interior of said first insulating shell.

7. The apparatus of claim 1 further comprising:

a power terminal configured to transfer power from an external power source to said heating element.

8. The apparatus of claim 7 wherein said power terminal and said heating element are classified as American Petroleum Institute (API) Class I, Division I.

9. The apparatus of claim 7 wherein said power terminal and said heating element are classified as API Class I, Division II.

10. The apparatus of claim 1 wherein the mechanism for securing comprises a belt and buckle combination.

11. The apparatus of claim 1 further comprising:

a second aperture configured to allow a portion of said gas recovery component to pass through said second aperture when said apparatus is secured about said gas recovery component, and so spaced from said at least one aperture so that said at least one aperture and said second aperture align with a first and second valve of said component, respectively, when said apparatus is secured about said gas recovery component.

12. The apparatus of claim 1 wherein said first and second shell are sufficiently flexible to bend around contours of said wellhead gas recovery component.

13. The apparatus of claim 1 wherein said heating element comprises a conductor that increases in temperature as current passes through said conductor.

14. The apparatus of claim 13 wherein said conductor is configured to dissipates heat evenly to said first and second shells.

15. The apparatus of claim of claim 14 wherein said heating element qualifies as explosion proof and fire proof.

16. The apparatus of claim 1 wherein said aperture is partially defined by a seam, said seam allowing the circumference of said aperture to change in response to a change in size of said wellhead gas recovery component passing through said aperture.

17. The apparatus of claim 1 wherein said first and second shell are adjacently aligned.

18. The apparatus of claim 1 wherein said first and second shell are sufficiently flexible to bend around contours of said wellhead gas recovery component.

19. The apparatus of claim 18 wherein said heating element comprises a conductor that increases in temperature as current passes through said conductor.

20. The apparatus of claim 19 wherein said conductor is configured to dissipates heat evenly to said first and second shells.

21. The apparatus of claim of claim 20 wherein said heating element qualifies as explosion proof and fire proof.

22. A method for heating a wellhead gas recovery component, said method comprising:

securing a heating apparatus about said wellhead gas recovery component, said heating apparatus comprising:

first and second insulating shells;

at least one heating element positioned between said first and second shells, and at least one aperture, said aperture configured to allow at least a portion of said wellhead gas recovery component to pass through said aperture; and a mechanism for securing said apparatus about said wellhead gas recovery component;

powering said heating element; and heating said wellhead gas recovery component in response to said powering.

23. The method of claim 22 further comprising:

varying the current through said heating element to effectuate a temperature change of said heating element.

24. The method of claim 22 wherein said heating apparatus further comprises:

a second insulating shell placed along the interior of said first insulating shell.

25. The method of claim 22 wherein said heating apparatus further comprises:

a power terminal configured to transfer power from an external power source to said heating element.

26. The method of claim 22 wherein said heating apparatus is configured to be secured upon a 5K-type frac stack.

27. The method of claim 22 wherein said heating apparatus is configured to be secured upon a 10K-type frac stack.

28. The method of claim 22 wherein said heating apparatus is configured to be secured upon a 15K-type frac stack.

29. The method of claim 22 wherein said heating apparatus further comprises a second aperture configured to allow a portion of said gas recovery component to pass through said second aperture when said apparatus is secured about said gas recovery component.

30. The apparatus of claim 22 wherein said aperture is partially defined by a seam, said seam allowing the circumference of said aperture to change in response to a change in size of said wellhead gas recovery component passing through said aperture.

31. The apparatus of claim 22 wherein said first and second shell are adjacently aligned.

* * * * *